US008882217B2

(12) United States Patent
Lea et al.

(10) Patent No.: US 8,882,217 B2
(45) Date of Patent: Nov. 11, 2014

(54) PRINTHEAD ASSEMBLY INCLUDING MEMORY ELEMENTS

(75) Inventors: Perry V. Lea, Eagle, ID (US); Gilberto M. Ribeiro, Palo Alto, CA (US); Matthew D. Pickett, San Francisco, CA (US); Jianhua Yang, Palo Alto, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 286 days.

(21) Appl. No.: 13/283,197

(22) Filed: Oct. 27, 2011

(65) Prior Publication Data

US 2013/0106930 A1 May 2, 2013

(51) Int. Cl.

| | |
|---|---|
| ***B41J 29/38*** | (2006.01) |
| ***B41J 2/05*** | (2006.01) |
| ***B41J 2/175*** | (2006.01) |

(52) U.S. Cl.

CPC ..... *B41J 2/1753* (2013.01); *B41J 2/17559* (2013.01); *B41J 2/17546* (2013.01)

USPC ..... 347/9; 347/58; 347/59

(58) Field of Classification Search

USPC ..... 347/9, 58–59

See application file for complete search history.

(56) References Cited

U.S. PATENT DOCUMENTS

| | | | | |
|---|---|---|---|---|
| 7,205,564 | B2 | 4/2007 | Kajiyama | |
| 7,576,565 | B2 | 8/2009 | Mouttet | |
| 7,896,476 | B2 | 3/2011 | Kubo et al. | |
| 7,954,929 | B2 | 6/2011 | Edelen et al. | |
| 2003/0081070 | A1 * | 5/2003 | Liu et al. | 347/58 |
| 2004/0160485 | A1 * | 8/2004 | Imanaka et al. | 347/58 |
| 2005/0285924 | A1 | 12/2005 | Yang | |

* cited by examiner

*Primary Examiner* — Jason Uhlenhake

(57) ABSTRACT

A printhead assembly for a printing device is provided that includes a printhead comprising non-volatile memory elements. The memory elements include memristive elements. Each memristive element includes an active region disposed between two electrodes. The active region includes a switching layer formed of a switching material capable of carrying a species of dopants and a conductive layer in electrical contact with the switching layer, the conductive layer being formed of a dopant source material that includes the species of dopants that are capable of drifting into the switching layer under an applied potential.

21 Claims, 4 Drawing Sheets

PRINTHEAD ASSEMBLY INCLUDING MEMORY ELEMENTS

BACKGROUND

Many inkjet printing systems include a printhead, an ink supply that supplies liquid ink to the printhead, and an electronic controller that controls the printhead. The system operates by propelling ink droplets, via a plurality of nozzles or orifices of the printhead, onto a medium (such as paper) to form text or an image on the medium. Many printheads include a silicon substrate and a device layer over the substrate. The device layer may include transistors, a heating resistor, and other components to facilitate proper operation of the printhead. The complexity of print cartridges is ever increasing as inkjet printing systems become more sophisticated.

BRIEF DESCRIPTION OF THE DRAWINGS

The accompanying drawings illustrate various embodiments of the principles described herein and are a part of the specification. The illustrated embodiments are merely examples and do not limit the scope of the claims.

Throughout the drawings, identical reference numbers designate similar, but not necessarily identical, elements.

DETAILED DESCRIPTION

In the following description, for purposes of explanation, numerous specific details are set forth in order to provide a thorough understanding of the present systems and methods. It will be apparent, however, to one skilled in the art that the present apparatus, systems and methods may be practiced without these specific details. Reference in the specification to "an embodiment," "an example" or similar language means that a particular feature, structure, or characteristic described in connection with the embodiment or example is included in at least that one embodiment or example, but not necessarily in other embodiments or examples. The various instances of the phrases "in one embodiment," "in one example," or similar phrases in various places in the specification are not necessarily all referring to the same embodiment or example.

As used herein, the term "includes" means includes but not limited to, the term "including" means including but not limited to. The term "based on" means based at least in part on.

The increasing complexity of print cartridges taxes memory capacity. Existing solutions for providing increased memory capacity are costly, and can require additional hardware and special interconnections. Integration of memory on the printhead assembly can help reduce the costs of the manufacturing process. Furthermore, existing non-silicon based technologies may not be able to facilitate electrically addressing digital data stored in a print cartridge.

Provided herein are printhead assemblies with integrated non-volatile memory elements. The memory elements are not substrate-specific. In a non-limiting example, the memory elements can be fabricated using a thin film technology, e.g., on a flexible substrate (such as a plastic substrate) or on a silicon substrate. Therefore, the memory elements can be positioned on any portion of the printhead cartridge. The printhead assembly with the integrated non-volatile memory allows for storage of data pertinent to the operation of the inkjet system during the lifetime of the printhead.

Figure 1:
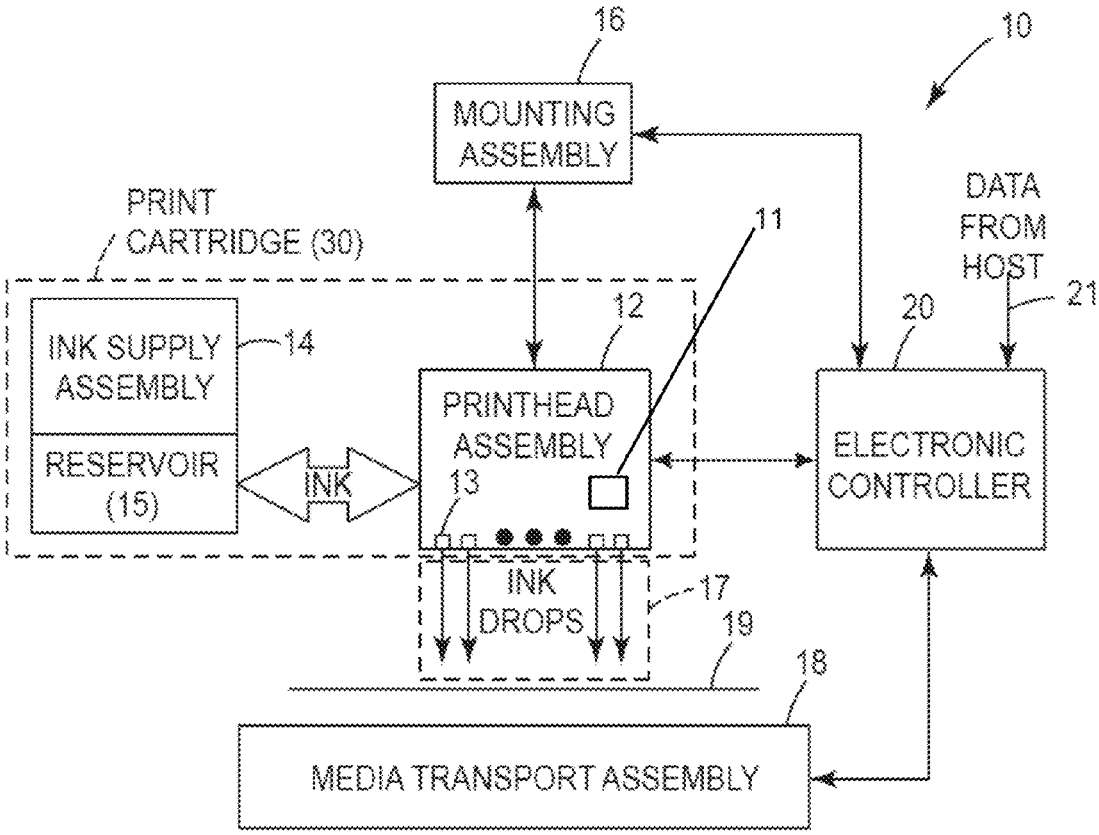
FIG. 1 is a block diagram of an example inkjet printing system.

FIG. 1 illustrates a non-limiting example of an inkjet printing system 10 to which the printhead assembly with integrated non-volatile memory elements described herein is applicable. Example inkjet printing system 10 includes printhead assembly 12 with integrated non-volatile memory elements 11, and a fluid supply, such as ink supply assembly 14. In the illustrated example, inkjet printing system 10 also includes a mounting assembly 16, a media transport assembly 18, and an electronic controller 20.

Printhead assembly 12, as a non-limiting example of a fluid ejection device, ejects drops of printing fluid, such as black and colored inks, via a plurality of ejection elements 13. Ejection elements 13 can be nozzles or orifices. Ink supply assembly 14 includes a reservoir 15 and supplies ink to printhead assembly 12. Printhead assembly 12 and ink supply assembly 14 may be housed together in a print cartridge or pen, as identified by dashed line 30. The integrated non-volatile memory elements 11 can be included at any position relative to the printhead assembly 12, including within the body of printhead assembly 12, on a surface of printhead assembly 12, or on a projection leading from printhead assembly 12. For example, non-volatile memory elements 11 can be integrated with a flexible member leading from printhead assembly 12. While the following description refers to the ejection of ink from printhead assembly 12, it is understood that other liquids, fluids, or flowable materials may be ejected from printhead assembly 12. Mounting assembly 16 positions printhead assembly 12 relative to media transport assembly 18, and media transport assembly 18 positions print media 19 relative to printhead assembly 12. A print zone 17 within which printhead assembly 12 deposits ink drops is defined in an area between printhead assembly 12 and print media 19. During printing, print media 19 is advanced through print zone 17 by media transport assembly 18.

In an example operation, the drops are directed toward a medium, such as print media 19, so as to print onto print media 19. Typically, ejection elements 13 are arranged in columns or arrays such that properly sequenced ejection of ink from the nozzles causes, in one example, characters, symbols, and/or other graphics or images to be printed upon print media 19 as printhead assembly 12 and print media 19 are moved relative to each other. Non-limiting examples of print media 19 include paper, card stock, envelopes, labels, transparent film, cardboard, and rigid panels. Print media 19 can be a continuous form or continuous web print media 19, and may include a continuous roll of unprinted paper.

Electronic controller 20 communicates with printhead assembly 12, mounting assembly 16, and media transport assembly 18. Electronic controller 20 receives data 21 from a host system, such as a computer, and includes memory for temporarily storing data 21. Data 21 can be transmitted to inkjet printing system 10 along an electronic, infrared, optical or other information transfer path. Data 21 represents, for example, a document and/or file to be printed. As such, data 21 forms a print job for inkjet printing system 10 and includes one or more print job commands and/or command parameters. Electronic controller 20 also provides control of printhead assembly 12 including timing control for ejection of ink drops by ejection elements 13. For example, electronic controller 20 can define a pattern of ejected ink drops which form characters, symbols, and/or other graphics or images on print media 19. Timing control and, therefore, the pattern of ejected ink drops, is determined by the print job commands and/or command parameters. Electronic controller 20 includes logic and drive circuitry for providing the control. Electronic controller 20 also can communicate with non-volatile memory elements 11. For example, electronic controller 20 may access information stored on non-volatile memory elements 11, and based in part on the information, modify the operation of printhead assembly 12.

Figure 2:
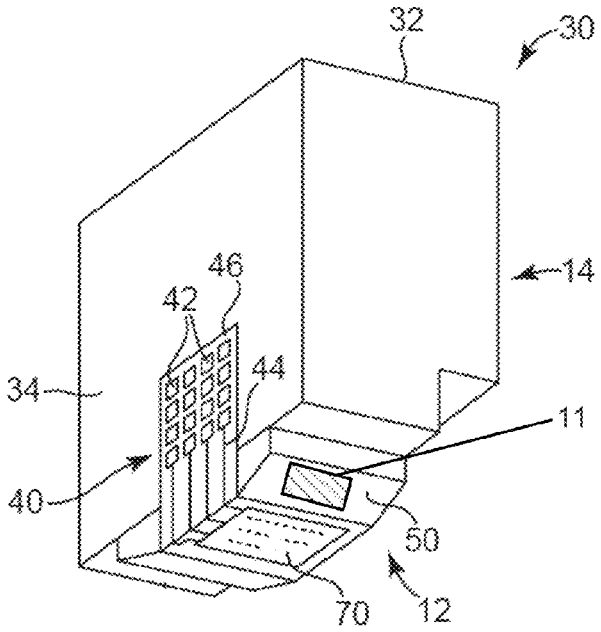
FIG. 2 is a perspective view of an example inkjet print cartridge.

FIG. 2 illustrates a non-limiting example print cartridge 30. The print cartridge 30 includes a printhead assembly 12 with integrated non-volatile memory elements 11, an ink supply assembly 14, and a housing 32 that supports printhead assembly 12. Housing 32 also supports an electrical circuit 40 which facilitates communication of electrical signals between electronic controller 20 (FIG. 1) and printhead assembly 12 for controlling and/or monitoring operation of printhead assembly 12.

In the example of FIG. 2, electrical circuit 40 includes a plurality of electrical contacts 42 and a plurality of conductive paths 44 which extend between and provide electrical connection between electrical contacts 42 and printhead assembly 12. Electrical contacts 42 provide points for electrical connection with print cartridge 30 and, more specifically, printhead assembly 12. As such, electrical contacts 42 facilitate communication of power, ground, and/or data signals to printhead assembly 12. In some examples, electrical circuit 40 may be supported by print cartridge 30 such that electrical contacts 42 are provided along a side 34 of housing 32 of print cartridge 30. Electrical circuit 40 may be a flexible electrical circuit, and conductive paths 44 may be formed in one or more layers of a flexible base material 46. Base material 46 may include, for example, a polyimide or other flexible polymer material (e.g., polyester, poly-methyl-methacrylate) and conductive paths 44 may be formed of copper, gold, or other conductive material. The example printhead assembly 12 includes integrated non-volatile memory elements 11, a base 50 and a printhead 70. Base 50 helps to provide mechanical support for and accommodates fluidic routing to printhead 70. Non-volatile memory elements 11 also may communicate with electrical circuit 40. In other examples, the integrated non-volatile memory elements 11 can be included at any position relative to the printhead 12, including within the body of printhead 12, on a surface of printhead 12, or on a projection leading from printhead 12. For example, non-volatile memory elements 11 can be integrated with a flexible member leading from printhead 12. In an example, non-volatile memory elements 11 can be integrated with a portion of electrical circuit 40, such as on base material 46.

A printhead assembly with integrated non-volatile memory elements according to a principle herein allows for storage of data pertinent to the operation of the inkjet system during the lifetime of the print cartridge. An example application of the integrated non-volatile memory is detection and storage of device status (including "out of ink" status). Another example application of the integrated non-volatile memory is ink validation. Other non-limiting examples of data that can be stored on the integrated non-volatile memory elements include cartridge model, manufacturing date, serial numbers, remaining ink level, born on date (such as date of first use), maximum ink level, nozzle health, coverage averages, environmental variables, device errors, ink cartridge validation. These data can have multiple applications.

In a non-limiting example, non-volatile memory elements include memristive elements. As described in connection with FIGS. 3A and 3B, each memristive element is a multilayer structure that is capable of retaining bit information even when power is turned off. In another non-limiting example, non-volatile memory elements may be formed from stacked arrays of the memristive elements, as described in connection with FIGS. 5, 5A, 5B and 5C. The stacked arrays can be three-dimensional (3D) circuits that include stacked, multiple layers of interconnected 2D arrays of the memristive elements. In non-limiting examples, the non-volatile memory elements can take the form of, for example, semiconductor memory devices, such as a dynamic random access memory, a resistance random access memory, a flash memory, a read-only memory, and a static random access memory.

Figure 3A:
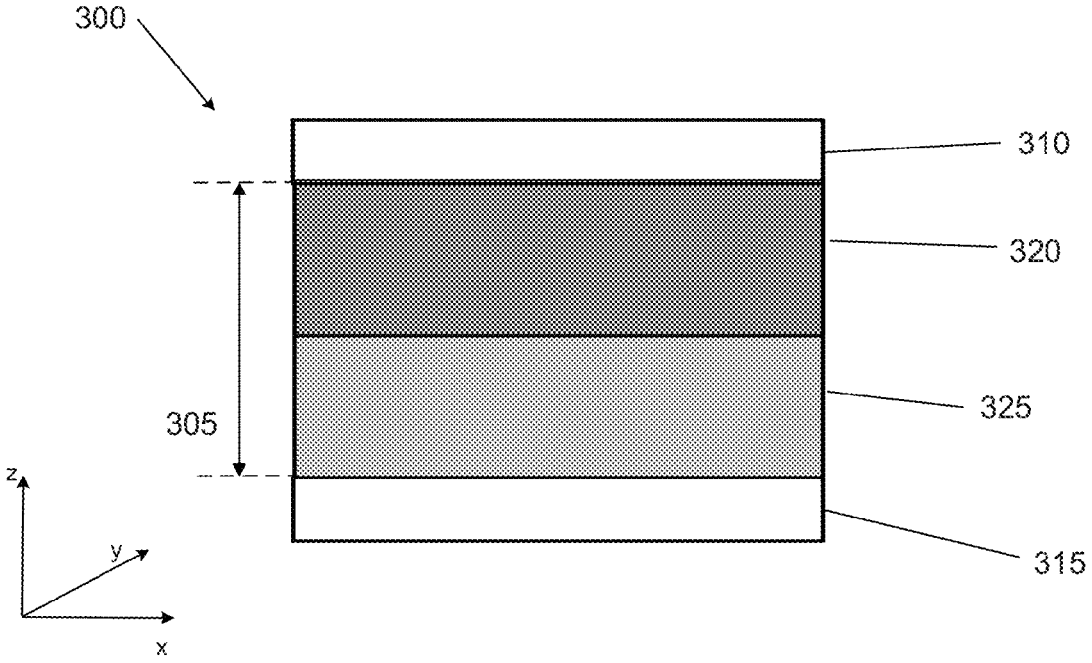
FIGS. 3A and 3B illustrate cross-sections of example of memristive elements.

FIG. 3A shows an example memristive element 300 according to a principle described herein. The memristive element 300 includes an active region 305 disposed between a first electrode 310 and a second electrode 315. The active region 305 including a switching layer 320 and a conductive layer 325 formed of a dopant source material. The insulating layer 320 is formed of a switching material capable of carrying a species of dopants and transporting the dopants under an applied potential. The conductive layer 325 is disposed between and in electrical contact with the switching layer 320. Conductive layer 325 is formed of a dopant source material that includes the species of dopants that are capable of drifting into the switching layer under the applied potential and thus changing the conductance of memristive element 300. When a potential is applied to memristive element 300 in a first direction, the switching layer develops an excess of the dopants. When the direction of the potential is reversed, the voltage potential polarity is reversed, and the drift direction of the dopants is reversed. The switching layer develops a deficiency of dopants.

Figure 3B:
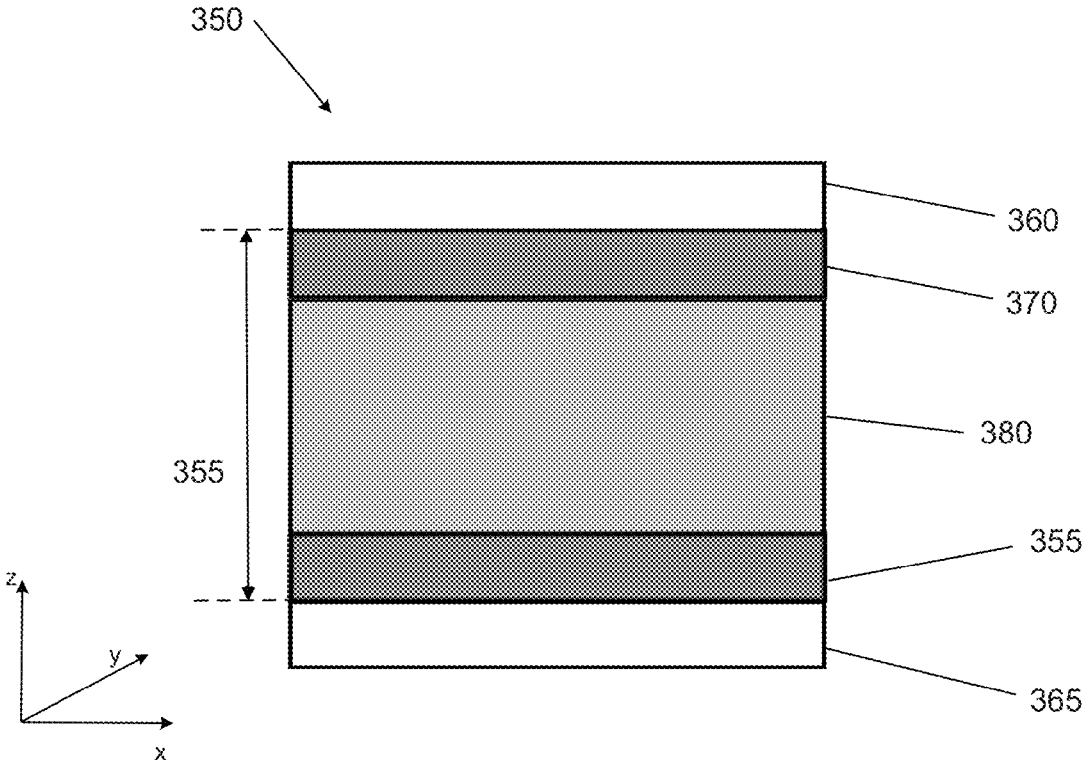

FIG. 3B shows another example memristive element 350 according to principles described herein. The memristive element 350 includes an active region 355 disposed between first electrode 360 and second electrode 365. The active region 305 including two switching layers 370, 375 and a conductive layer 380 formed of a dopant source material. The switching layers 370, 375 are each formed of a switching material capable of carrying a species of dopants and transporting the dopants under an applied potential. The conductive layer 380 is disposed between and in electrical contact with the switching layers 370, 375. Conductive layer 380 is formed of a dopant source material that includes the species of dopants that are capable of drifting into the switching layers under the applied potential and thus changing the conductance of memristive element 350. When a potential is applied to memristive element 350 in a first direction (such as in the positive z-axis direction), one of the switching layers develops an excess of the dopants and the other switching layer develops a deficiency of the dopants. When the direction of the potential is reversed the voltage potential polarity is reversed, and the drift direction of the dopants is reversed. The first switching layer develops a deficiency of dopants and the other switching layer develops an excess of dopants.

Typically, the switching material is an electronically insulating, semiconducting, or a weak ionic conductor. For example, the switching material can be a highly insulating stoichiometric compound. Examples of the switching material include a carbonate of silicon (including $SiCO_4$), an oxide of aluminum, an oxide of titanium (including $TiO_2$), an oxide of silicon (including $SiO_2$), an oxide of gallium, an oxide of germanium, and an oxide of a transition metal (including oxides of Sc, Ti, V, Cr, Mn, Fe, Co, Ni, Cu, Zn, Y, Zr, Nb, Mo, Hf, Ta, W, or Re). In non-limiting examples, the switching material is $TiO_2$, $TaO_x$, where $0<x\leq 2.5$, or NiO. Other examples of the switching material include a nitride of aluminum (including AlN), a nitride of silicon, a nitride of gallium, a nitride of germanium, and a nitride of a transition metal (including nitrides of Sc, V, Cr, Mn, Fe, Co, Ni, Cu, Zn, Y, Zr, Nb, Mo, Hf, and Re).

The dopant source material is the source of the doping species for the switching material, and includes a relatively high concentration of dopants of the type that can be transported by the switching material. However, the dopant source material differs from the switching material by at least one metal ion. That is, the metal oxides of the switching layer and the conductive layer differ by at least one metal ion. The result is formation of a hetero-junction between the switching layer and the conductive layer. Examples of dopant source material include titanium sulphide, titanium phosphide, $Ti_4O_7$, $TiO_{2-x}$ ($0<x<1$), $AlN_{1-w}$ ($0<w<0.2$), a ternary system (e.g., $SrTiO_{1-y}$ ($0<y\leq 0.2$)), or a quaternary system. In non-limiting examples, the dopant source material is $RuO_2$, $WO_z$, where $0<z\leq 3$. The type of dopant depends on the type of dopant source material and switching material used. For example, in a system where the dopant source material $AlN_{1-w}$ is used with switching material AlN, the dopant is nitrogen vacancies. For example, where the dopant source material is $Ti_4O_7$, the dopant is oxygen vacancies.

In an example, the switching layer and the conductive layer each are formed of a metal oxide. The metal oxide of either layer can be an oxide of Al, Si, Ga, Ge, Sr, Ba, Sc, Ti, V, Cr, Mn, Fe, Co, Ni, Cu, Zn, Y, Zr, Nb, Mo, Tc, Ru, Rh, Pd, Ag, Cd, La, Hf, Ta, W, Re, Os, Ir, or Pt, or some combination thereof. The metal oxides of the switching layer and the conductive layer differ by at least one metal ion. That is, a metal ion of the metal oxide of the switching layer differs from a metal ion of the metal oxide of the conductive layer. As an example, if the switching layer includes an oxide of metal A, then the conductive layer includes an oxide of metal B, where metal A is not the same as metal B. Another example is where the switching layer includes an oxide of metals A and C, and the conductive layer includes an oxide of metals C and D, where metal D is not the same as metal A. The memristive element includes a hetero-junction between the switching layer and the conductive layer due to the dissimilarity in the metal ions between the switching layer and the conductive layer.

In a non-limiting example, the switching material is an oxide of tantalum, including $TaO_x$, where $0<x\leq 2.5$, and the dopant source material is an oxide of titanium, including $Ti_nO_{2n-1}$, where n=2, 3, 4, 5, . . . , 20.

In another non-limiting example, the switching material is an oxide of tantalum, including $TaO_x$, where $0<x\leq 2.5$, and the dopant source material is an oxide of tungsten, including $WO_{3-y}$, where $0\leq y\leq 1$.

The thickness of the switching layer in some examples can be about 10 nm or less, about 6 nm or less, about 4 nm or less, about 2 nm or less, or less than 1 nm. For example, the thickness of the switching layer can be about 0.5 nm or less. The conductive layer can be about the same thickness as the switching layer, or can be thicker than the switching layer. For example, the thickness of the conductive layer may range from 2 nm to 200 nm. Either of the electrodes can be made of platinum between about 7 nm and about 100 nm thick, or thicker. In another example, the electrode can be a copper/tantalum nitride/platinum system, where the copper is a very good conductor, and the tantalum nitride acts as a diffusion barrier between the copper and the platinum.

Figure 4:
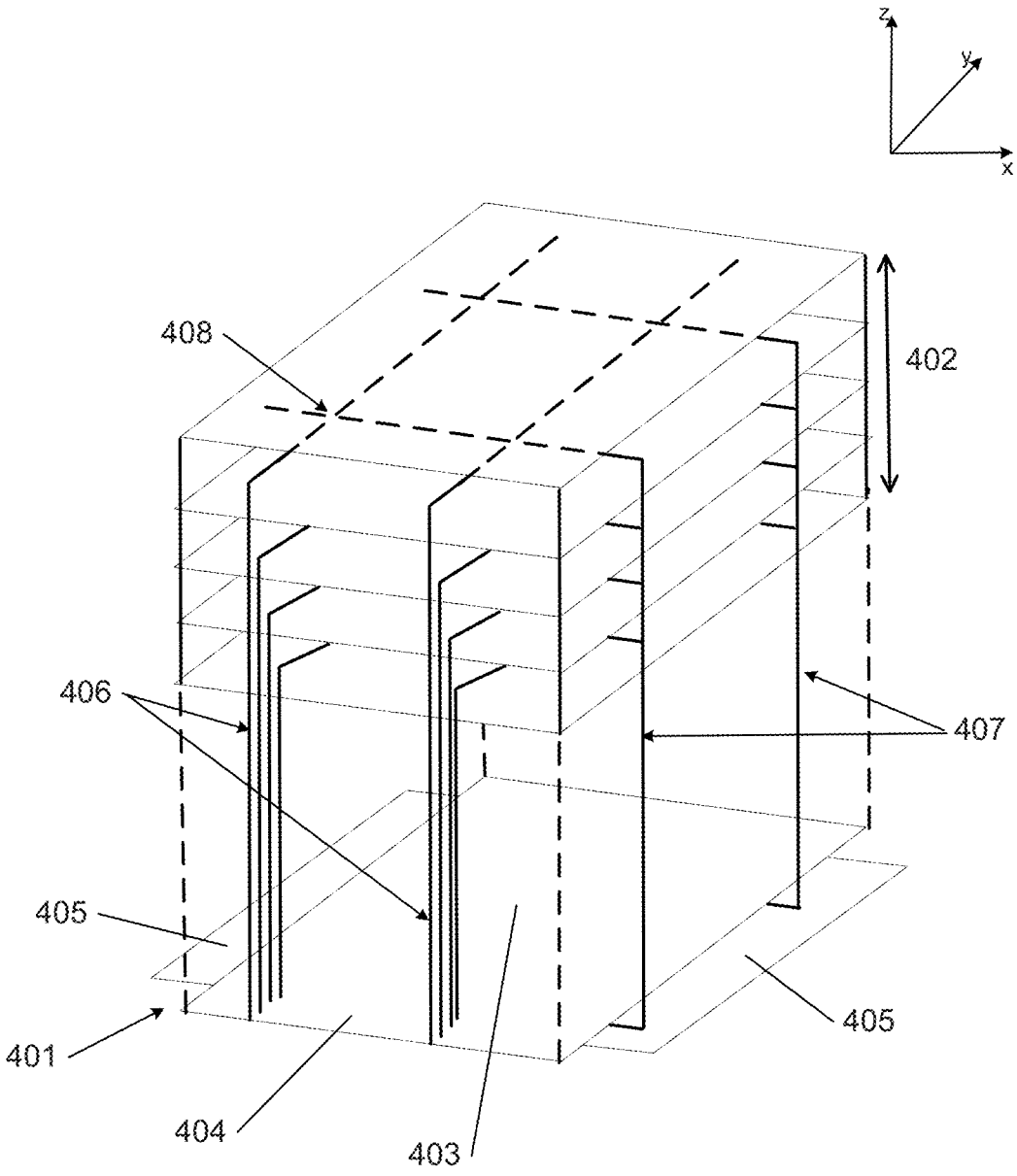
FIG. 4 illustrates an example memory element that includes an array of memristive elements.

In another non-limiting example, non-volatile memory elements may be formed from stacked arrays of the memristive elements. FIG. 4 illustrates an example memory element formed as a stacked array of interconnected memristive elements arranged in a 3D architecture. The memory element is configured as a base on which a memory circuit 402 is laminated, with conductive lines 406, 407 leading from the base to each layer of the memory element. The example of FIG. 4 shows a memory element having edge-disposed conductive lines 406 and 407. Memristive elements 408 are positioned in each 2D array on each layer at the intersection of conductive lines 406 and 407. Conductive lines 406, 407 provide electrical connectivity between the memristive elements and the base. The base includes a semiconductor substrate 401, a wiring area 403 (such as formed from CMOS circuitry), and contact areas 404 and 405 for the conductive lines. Conductive lines 406 and 407 connect each layer of interconnected memory cells to the wiring area 403 formed on the semiconductor substrate 401. Contact areas 404 and 405 are provided along four edges of the wiring area 403. The memory circuit 402 is illustrated as having four layers of 2D arrays of the interconnected memristive elements. However, the memory circuit can include more or fewer than four layers of 2D arrays. The wiring area 403 is provided in the semiconductor substrate 401 below the memory circuit 402. In the wiring area 403, a global bus or the like is used for providing instructions for writing (i.e., putting memristive elements to ON or OFF states) or reading from the circuit 402 with outside sources. That is, the external voltage is applied to memristive element(s) using conductive lines 406 and 407. In some examples, wiring area 403 includes a column control circuit including a column switch and/or a row control circuit including a row decoder. The base can be integrated with complementary metal-oxide-semiconductor (CMOS) or other conventional computer circuitry. The CMOS circuitry can be configured to selectively address, including applying the potential, to the targeted memristive element(s). For example, the CMOS circuitry can be used to apply the read and write voltages to the conductive lines as described above. This CMOS circuitry can provide additional functionality to the memory element such as input/output functions, buffering, logic, or other functionality.

Figure 5B:
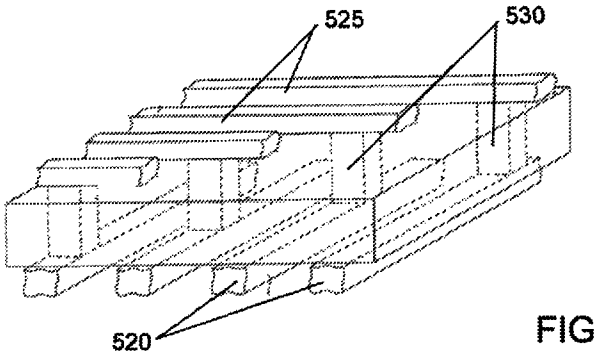
FIG. 5B illustrates a perspective view of the example memory element of FIG. 5A.
Figure 5C:
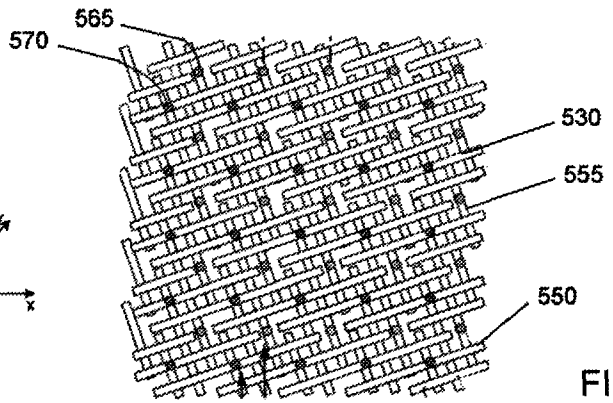
FIG. 5C illustrates a top view of the example memory element of FIG. 5A.
Figure 5A:
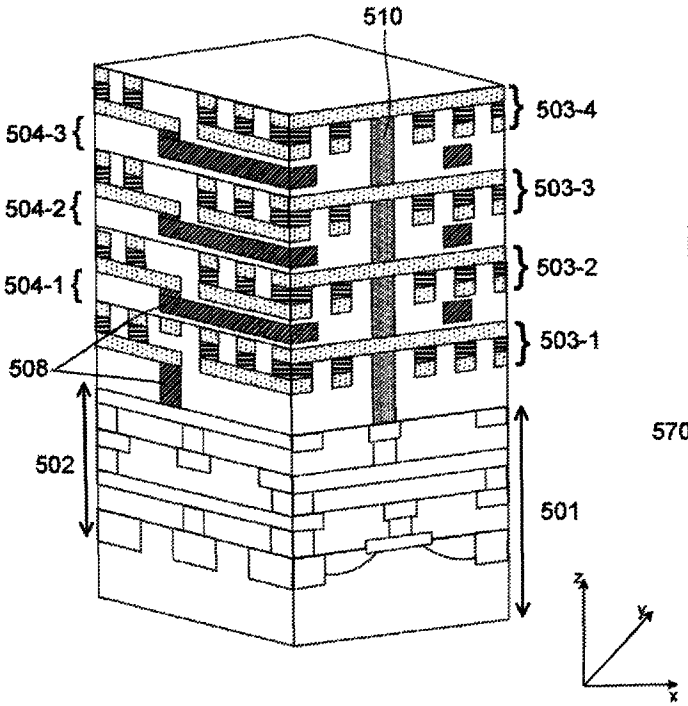
FIG. 5A illustrates another example memory element that includes an array of memristive elements.

FIG. 5A illustrate another example of a memory element formed as a stacked array of interconnected memristive elements arranged in a 3D architecture. The memory element 500 includes a base 501 and a multilayer circuit disposed above the base. The base includes a CMOS layer 502. The multilayer circuit includes layers of interconnected memristive elements, each layer being formed as a 2D crossbar array 503-*i* (i=1, . . . , 4). FIG. 5B illustrates a portion of a 2D crossbar array composed of a lower layer of approximately parallel nanowires 520 that are overlain by an upper layer of approximately parallel nanowires 525. The nanowires of the upper layer 525 are roughly perpendicular, in orientation, to the nanowires of the lower layer 520, although the orientation angle between the layers may vary. The two layers of nanowires form a lattice, or crossbar, in which each nanowire of the upper layer 525 overlies all of the nanowires of the lower layer 520. In this example, the memristive elements 530 are formed between the crossing nanowires at these intersections. Consequently, each nanowire 525 in the upper layer is connected to every nanowire 520 in the lower layer through a memristive element and vice versa. FIG. 5C illustrates a top view of the crossbar array, showing a set of upper crossbar wires (550), a set of lower crossbar wires (555), and a number of programmable memristive elements (560) interposed at the intersection between the upper crossbar wires (550) and the lower crossbar wires (555).

Different types of conductive lines form the conductive path that leads from the base to the memristive elements of the crossbar arrays of the example memory element of FIG. 5A. One type of conductive line is wiring layers 504-*i* (i=1, . . . , 3) that are interposed between successive crossbar arrays 503-*i* (see FIG. 5A). Another type of conductive line that form the conductive path that connects the crossbar array to the base is two groups of vias 508, 510 (see FIG. 5A). A first group of vias 508 connects to the lower crossbar lines (nanowires 520) and a second group of vias 510 connects to the upper crossbar lines (nanowires 525). The second vias 510 pass through all the crossbar arrays 503-*i* and wiring layers 504-*i* as a vertical column. In contrast, the locations of the first vias 508 are shifted in each successive wiring layer 504-*i*. FIG. 5C also shows a top view of the first vias 565 and second vias 570 in the 2D crossbar array. Portions of the nanowires 520, 525 between the memristive elements also serve as conductive lines. Non-limiting examples of the use of the conductive lines, including the wiring layers 504-*i*, first vias 508, second vias 510, lower crossbar lines (nanowires 520) and upper crossbar lines (nanowires 525), to uniquely address (including applying voltages to read data and/or to write data (i.e., set to an ON or OFF state)) to the memristive elements in the memory element of FIGS. 5A-C are also described in international application no. PCT/US2009/039666, filed Apr. 6, 2009, titled "Three-Dimensional Multilayer Circuit," which is incorporated herein by reference in its entirety. The CMOS circuitry can be configured to selectively address (including applying external voltages to) ones of the memristive elements using the conductive lines (including the wiring layers 504-*i*, first vias 508, second vias 510, lower crossbar lines (nanowires 520) and upper crossbar lines (nanowires 525)).

As described above, the non-volatile memory elements can take the form of, for example, semiconductor memory devices, such as a dynamic random access memory, a resistance random access memory, a flash memory, a read-only memory, and a static random access memory. The read/write operations may not be the same for the different types of memories, but in general, e.g., read involves sensing either the charge of a particular memristive element or passing current through the memristive element.

In an example, the non-volatile memory elements can be formed using thin film deposition on any substrate or other deposition technology. The bits of the non-volatile memristor elements can be constructed using thin film deposition of metal species (including transition metal oxides or nitrides), and capped with electrodes (as described relative to FIGS. 3A and 3B). The memory elements can be formed in the many different stacking arrangements using the thin film technology. In non-limiting examples, the non-volatile memory elements may be arranged in the crossbar architecture or other architecture (as described relative to FIGS. 4, 5A, 5B and 5C).

The printhead assembly with integrated non-volatile memory elements provides several advantages. For example, it can facilitate lower operation voltage of the system, reduced use of energy, and faster operating speeds speed compared with traditional silicon-based floating gate transistors. It can also provide the printing system with the advantage of immunity to photo disturbance. The printhead assembly with integrated non-volatile memory elements described herein facilitates cartridges to have local, non-volatile, cheap, substrate agnostic memory. The printhead assembly with integrated non-volatile memory elements also facilitates embedding a low cost storage medium on thermal ink heads directly onto the substrate without requiring additional cost of discrete memory parts. For example, the manufacturing process of thermal ink heads follows a CMOS fabrication methodology and lends itself easily to the manufacture of the memory elements in a sputtering/dry etch process. The information stored on the non-volatile memory elements can be used, for example, to identify ink quality and ink supply levels of the printing system. The information stored on the non-volatile memory elements can also be used for storing information related to the quality of performance of the printing system.

The preceding description has been presented only to illustrate and describe embodiments and examples of the principles described. This description is not intended to be exhaustive or to limit these principles to any precise form disclosed. Many modifications and variations are possible in light of the above teaching.

What is claimed is:

1. A printhead assembly for a printing device, comprising:
a printhead comprising non-volatile memory elements, wherein the memory elements comprise memristive elements, and wherein each memristive element comprises:
an active region disposed between and in electrical contact with first and second electrical contacts, the active region having a switching layer formed of a switching material capable of carrying a species of dopants and transporting the dopants under an applied potential and a conductive layer in electrical contact with the switching layer, the conductive layer being formed of a dopant source material that includes the species of dopants that are capable of drifting into the switching layer under the applied potential.

2. The printhead assembly of claim 1, wherein the switching material comprises an insulating material, wherein the insulating material comprises an oxide of aluminum, an oxide of silicon, a carbonate of silicon, an oxide of gallium, an oxide of germanium, or an oxide of a transition metal, wherein the transition metal is Sc, Ti, V, Cr, Mn, Fe, Co, Ni, Cu, Zn, Y, Zr, Nb, Mo, Hf, Ta, W, or Re, wherein the dopant source material comprises a conductive material, wherein the conductive material is an oxide of aluminum, an oxide of silicon, a carbonate of silicon, an oxide of gallium, an oxide of germanium, or an oxide of a transition metal, and wherein the transition metal is Sc, Ti, V, Cr, Mn, Fe, Co, Ni, Cu, Zn, Y, Zr, Nb, Mo, Hf, Ta, W, or Re.

3. The printhead assembly of claim 2, wherein the switching material is $TiO_2$ and wherein the dopant source material is $Ti_4O_7$.

4. The printhead assembly of claim 2, wherein the switching material is $TaO_x$, wherein $0<x\leq 2.5$, and wherein the dopant source material is $Ti_4O_7$.

5. The printhead assembly of claim 1, wherein the switching material comprises an insulating material, wherein the insulating material comprises a nitride of aluminum, a nitride of silicon, a nitride of gallium, a nitride of germanium, or a nitride of a transition metal, wherein the transition metal is Sc, V, Cr, Mn, Fe, Co, Ni, Cu, Zn, Y, Zr, Nb, Mo, Hf, or Re, wherein the dopant source material comprises a conductive material, wherein the conductive material is nitride of aluminum, a nitride of silicon, a nitride of gallium, a nitride of germanium, or a nitride of a transition metal, and wherein the transition metal is Sc, V, Cr, Mn, Fe, Co, Ni, Cu, Zn, Y, Zr, Nb, Mo, Hf, or Re.

6. The printhead assembly of claim 5, wherein the switching material is aluminum nitride and the dopant source material is $AlN_{1-y}$, wherein $0<y\leq 0.2$.

7. The printhead assembly of claim 1, wherein the active region of at least one of the memristive elements comprises two switching layers formed of the switching material, wherein the conductive layer is disposed between and in electrical contact with the switching layers, and wherein the species of dopants are capable of drifting into the switching layers under the applied potential.

8. The printhead assembly of claim 7, wherein a first switching layer of the two switching layers develops an excess of dopants and a second switching layer of the two switching layers develops a deficiency of dopants when the potential is applied is in a first direction, and wherein the first switching layer of the two switching layers develops a deficiency of dopants and the second switching layer of the two switching layers develops an excess of dopants when the potential is applied is in a second direction that is opposite to the first direction.

9. The printhead assembly of claim 7, wherein the switching material comprises an insulating material, wherein the insulating material comprises an oxide of aluminum, an oxide of silicon, a carbonate of silicon, an oxide of gallium, an oxide of germanium, or an oxide of a transition metal, wherein the transition metal is Sc, Ti, V, Cr, Mn, Fe, Co, Ni, Cu, Zn, Y, Zr, Nb, Mo, Hf, Ta, W, or Re, wherein the dopant source material comprises a conductive material, wherein the conductive material is an oxide of aluminum, an oxide of silicon, a carbonate of silicon, an oxide of gallium, an oxide of germanium, or an oxide of a transition metal, and wherein the transition metal is Sc, Ti, V, Cr, Mn, Fe, Co, Ni, Cu, Zn, Y, Zr, Nb, Mo, Hf, Ta, W, or Re.

10. The printhead assembly of claim 9, wherein the switching material is $TiO_2$ and wherein the dopant source material is $Ti_4O_7$.

11. The printhead assembly of claim 9, wherein the switching material is $TaO_x$, wherein $0<x\leq 2.5$, and wherein the dopant source material is $Ti_4O_7$.

12. The printhead assembly of claim 7, wherein the switching material comprises an insulating material, wherein the insulating material comprises a nitride of aluminum, a nitride of silicon, a nitride of gallium, a nitride of germanium, or a nitride of a transition metal, wherein the transition metal is Sc, V, Cr, Mn, Fe, Co, Ni, Cu, Zn, Y, Zr, Nb, Mo, Hf, or Re, wherein the dopant source material comprises a conductive material, wherein the conductive material is nitride of aluminum, a nitride of silicon, a nitride of gallium, a nitride of germanium, or a nitride of a transition metal, and wherein the transition metal is Sc, V, Cr, Mn, Fe, Co, Ni, Cu, Zn, Y, Zr, Nb, Mo, Hf, or Re.

13. The printhead assembly of claim 12, wherein the switching material is aluminum nitride and the dopant source material is $AlN_{1-y}$, wherein $0<y\leq 0.2$.

14. A printhead assembly for a printing device, comprising:

a printhead comprising non-volatile memory elements, wherein the memory elements comprise a stacked array of memristive elements, and wherein each memristive element comprises:

an active region disposed between and in electrical contact with first and second electrical contacts, the active region having a switching layer formed of a switching material capable of carrying a species of dopants and transporting the dopants under an applied potential and a conductive layer in electrical contact with the switching layer, the conductive layer being formed of a dopant source material that includes the species of dopants that are capable of drifting into the switching layer under the applied potential.

15. The printhead assembly of claim 14, wherein the memory elements comprise:

a via array comprising a set of first vias and a set of second vias;

a complementary metal-oxide-semiconductor (CMOS) layer to selectively address the set of first vias and the set of second vias; and at least two crossbar arrays configured to overlie the CMOS layer and communicate with at least one of the first vias and the second vias, each of the at least two crossbar arrays intersect at a plurality of intersections, wherein each of the memristive elements is interposed at one of the intersections.

16. The printhead assembly of claim 14, wherein the switching material comprises an insulating material, wherein the insulating material is selected from the group consisting of an oxide of titanium, oxide of hafnium, oxide of zirconium, aluminum nitride, an oxide of silicon, a carbonate of silicon and an oxide of a transition metal, and wherein the transition metal is Sc, Ti, V, Cr, Mn, Fe, Co, Ni, Cu, Zn, Y, Zr, Nb, Mo, Hf, Ta, W, or Re.

17. The printhead assembly of claim 16, wherein the switching material is an oxide of titanium, wherein the dopant source material is $TiO_{2-x}$, and wherein $0<x\leq 1$.

18. The printhead assembly of claim 16, wherein the switching material is $TiO_2$ and wherein the dopant source material is $Ti_4O_7$.

19. The printhead assembly of claim 16, wherein the switching material is $TaO_x$, wherein $0<x\leq 2.5$, and wherein the dopant source material is $Ti_4O_7$.

20. The printhead assembly of claim 14, wherein the switching material comprises an insulating material, wherein the insulating material comprises a nitride of aluminum, a nitride of silicon, a nitride of gallium, a nitride of germanium, or a nitride of a transition metal, and wherein the transition metal is Sc, V, Cr, Mn, Fe, Co, Ni, Cu, Zn, Y, Zr, Nb, Mo, Hf, or Re.

21. The printhead assembly of claim 20, wherein the switching material is aluminum nitride, wherein the dopant source material is $AlN_{1-w}$., and wherein $0<w\leq 0.2$.

* * * * *

UNITED STATES PATENT AND TRADEMARK OFFICE

CERTIFICATE OF CORRECTION

PATENT NO. : 8,882,217 B2
APPLICATION NO. : 13/283197
DATED : November 11, 2014
INVENTOR(S) : Perry V. Lea et al.

It is certified that error appears in the above-identified patent and that said Letters Patent is hereby corrected as shown below:

In the Claims,

In column 10, line 52, in Claim 21, delete "$AlN_{1-w}$.," and insert -- $AlN_{1-w}$, --, therefor.

Signed and Sealed this
Nineteenth Day of May, 2015

Michelle K. Lee

Michelle K. Lee
*Director of the United States Patent and Trademark Office*